US011628679B2

(12) United States Patent
Robin

(10) Patent No.: US 11,628,679 B2
(45) Date of Patent: Apr. 18, 2023

(54) GRAPHIC ALIGNMENT TOOL AND METHOD OF USING THE SAME

(71) Applicant: Louis Joseph Robin, Stockton, CA (US)

(72) Inventor: Louis Joseph Robin, Stockton, CA (US)

( * ) Notice: Subject to any disclaimer, the term of this patent is extended or adjusted under 35 U.S.C. 154(b) by 218 days.

(21) Appl. No.: 17/247,956

(22) Filed: Dec. 31, 2020

(65) Prior Publication Data

US 2021/0206158 A1 Jul. 8, 2021

Related U.S. Application Data

(60) Provisional application No. 62/958,455, filed on Jan. 8, 2020.

(51) Int. Cl.

| | |
|---|---|
| ***B43L 13/02*** | (2006.01) |
| ***B43L 13/00*** | (2006.01) |
| ***B43L 13/14*** | (2006.01) |
| *B41F 1/28* | (2006.01) |

(52) U.S. Cl.

CPC ..... *B43L 13/028* (2013.01); *B43L 13/02* (2013.01); *B43L 13/142* (2013.01); *B43L 13/149* (2013.01); *B41F 1/28* (2013.01); *B43L 13/00* (2013.01)

(58) Field of Classification Search

CPC ..... B43L 13/028; B43L 13/02; B43L 13/142; B43L 13/149; B43L 13/00; B41F 1/28; B41F 16/0093

See application file for complete search history.

(56) References Cited

U.S. PATENT DOCUMENTS 2,872,735 A * 2/1959 Roberts ..... B43L 13/048 33/427
2,954,609 A * 10/1960 Goertz ..... B43L 13/04 33/443
3,083,901 A * 4/1963 Gabriel ..... G06G 1/00 33/456
5,035,061 A * 7/1991 Bradbury ..... B23Q 9/0028 30/373
5,353,515 A * 10/1994 Alvis ..... B27B 27/04 83/522.19
5,461,794 A * 10/1995 Huang ..... G01B 3/56 33/456
5,860,219 A * 1/1999 Wilkinson ..... H02G 1/00 33/528

(Continued)

*Primary Examiner* — Yaritza Guadalupe-McCall
(74) *Attorney, Agent, or Firm* — Dunlap Bennett & Ludwig, PLLC

(57) ABSTRACT

A graphic alignment tool and a method of using the same are disclosed. The graphic alignment provides for a placement of a graphic on a substrate. The graphic alignment tool includes a T-shaped center bar having a base vertically disposed and a collar plate laterally disposed at a top end of the base. A width bar is dimensioned to laterally extend across a width of the substrate. A rod is configured to be received in each of the slot and the alignment slot to slidably retain the width bar in a squared orientation relative the T-shaped center bar. A logo grid may also be provided for alignment of a graphic on a chest area of the substrate. The logo grid may be slidably retained with the T-shaped center bar via a rod and a grid slot defined in the logo grid.

9 Claims, 5 Drawing Sheets

(56) References Cited

U.S. PATENT DOCUMENTS

| | | | | |
|---|---|---|---|---|
| 7,559,153 | B2 * | 7/2009 | Allen | B25H 7/00 33/645 |
| 7,637,028 | B2 * | 12/2009 | Allen | A44C 3/002 33/645 |
| 7,739,806 | B1 * | 6/2010 | Pater | B25H 7/02 33/417 |
| 8,112,898 | B2 * | 2/2012 | Allen | A44C 3/002 33/645 |
| 9,635,907 | B2 * | 5/2017 | Romero | A43D 8/22 |
| 2007/0266500 | A1 * | 11/2007 | Allen | B25H 7/00 7/164 |
| 2009/0307917 | A1 * | 12/2009 | Allen | B25H 7/00 33/645 |
| 2014/0331417 | A1 * | 11/2014 | Romero | A43D 8/22 12/123 |
| 2021/0206158 | A1 * | 7/2021 | Robin | B41F 16/0093 |

* cited by examiner

GRAPHIC ALIGNMENT TOOL AND METHOD OF USING THE SAME

CROSS-REFERENCE TO RELATED APPLICATION

This application claims the benefit of priority of U.S. provisional application No. 62/958,455, filed Jan. 8, 2020, the contents of which are herein incorporated by reference.

BACKGROUND OF THE INVENTION

The present invention relates to graphics application to wares, and more particularly to alignment tools for applying graphics to wares.

A heat press is a machine engineered to imprint a design or graphic on a substrate, such as a t-shirt, with the application of heat and pressure for a preset period of time. While heat presses are often used to apply designs to fabrics, specially designed presses can also be used to imprint designs on mugs, plates, jigsaw puzzles, caps, and other products.

When applying graphics to such wares, it is desirable for the graphic to be aligned at a desired vertical, a lateral, and, in some instances, a rotational orientation on the wares.

Current alignment tools provide for alignment in one of a vertical and a horizontal direction. While the alignment tools may be overlaid relative to each other, they are susceptible to becoming misaligned. As such, these alignment tools are limited when combining the two orientations, and do not provide a way of reliably joining alignment tools for such combined use.

As can be seen, there is a need for an improved graphics alignment tools and methods of using the same.

SUMMARY OF THE INVENTION

In one aspect of the present invention, a graphic alignment tool for positioning a graphic on a substrate is disclosed. The graphic alignment tool includes a T-shaped center bar having a base vertically disposed and a collar plate laterally disposed at a top end of the base. A slot is defined along a longitudinal length of the base. A width bar is dimensioned to laterally extend across a width of the substrate. An alignment slot is defined at a midpoint of the width bar and extends transversely across the width bar. A rod is configured to be received in each of the slot and the alignment slot to slidably retain the width bar in a squared orientation relative the T-shaped center bar.

In some embodiments, a logo grid is included. The logo grid has an alignment grid disposed on a surface. At least one grid slot is defined along a vertical orientation of the logo grid. At least one grid alignment rod is configured to be received in each of the slot and the grid slot to slidably retain the logo grid in a squared orientation relative the T-shaped center bar.

In some embodiments, a plurality of collar alignment indicia are disposed transversely in a spaced apart relation along the collar plate of the T-shaped center bar. The collar alignment indicia provide for a centered alignment with a seam of a collar on the substrate.

In other embodiments, a plurality of vertical spacing indicia are disposed in a vertically spaced apart relation along the longitudinal length of the T-shaped center bar.

In yet other embodiments, a plurality of lateral placement indicia are disposed in a spaced apart relation across a length of the width bar.

In other embodiments, each of the plurality of collar alignment indicia, the plurality of vertical spacing indicia, and the plurality of lateral placement indicia comprise arrows.

In other embodiments, each of the plurality of collar alignment indicia, the plurality of vertical spacing indicia, and the plurality of lateral placement indicia further comprise a numeric designation.

In other aspects of the invention, a method of placing a graphic on a substrate is disclosed. The method includes placing a graphic alignment tool on the substrate. The graphic alignment tool has a T-shaped center bar, a base vertically disposed, a collar plate laterally disposed at a top end of the base, and a slot defined along a longitudinal length of the base. A rod is placed in the slot. A width bar, dimensioned to laterally extend across a width of the substrate, is slidably joined to the T-shaped center bar by receiving the rod in an alignment slot defined at a midpoint of the width bar and extending transversely across the width bar.

In some embodiments, the method includes sliding the width bar along the longitudinal length of the base to obtain a desired placement of the graphic on the substrate.

In some embodiment, a logo grid is slidably joined with the base of the T-shaped center bar via a grid rod received in the slot and at least one grid slot defined in the logo grid.

In some embodiments, the method includes sliding the logo grid along the longitudinal length of the slot to a desired placement of the logo grid with the substrate.

In yet other embodiments, the method includes applying a graphic to the substrate at a position indicated by at least one of the width bar and the logo grid.

These and other features, aspects and advantages of the present invention will become better understood with reference to the following drawings, description and claims.

DETAILED DESCRIPTION

Figure 1:
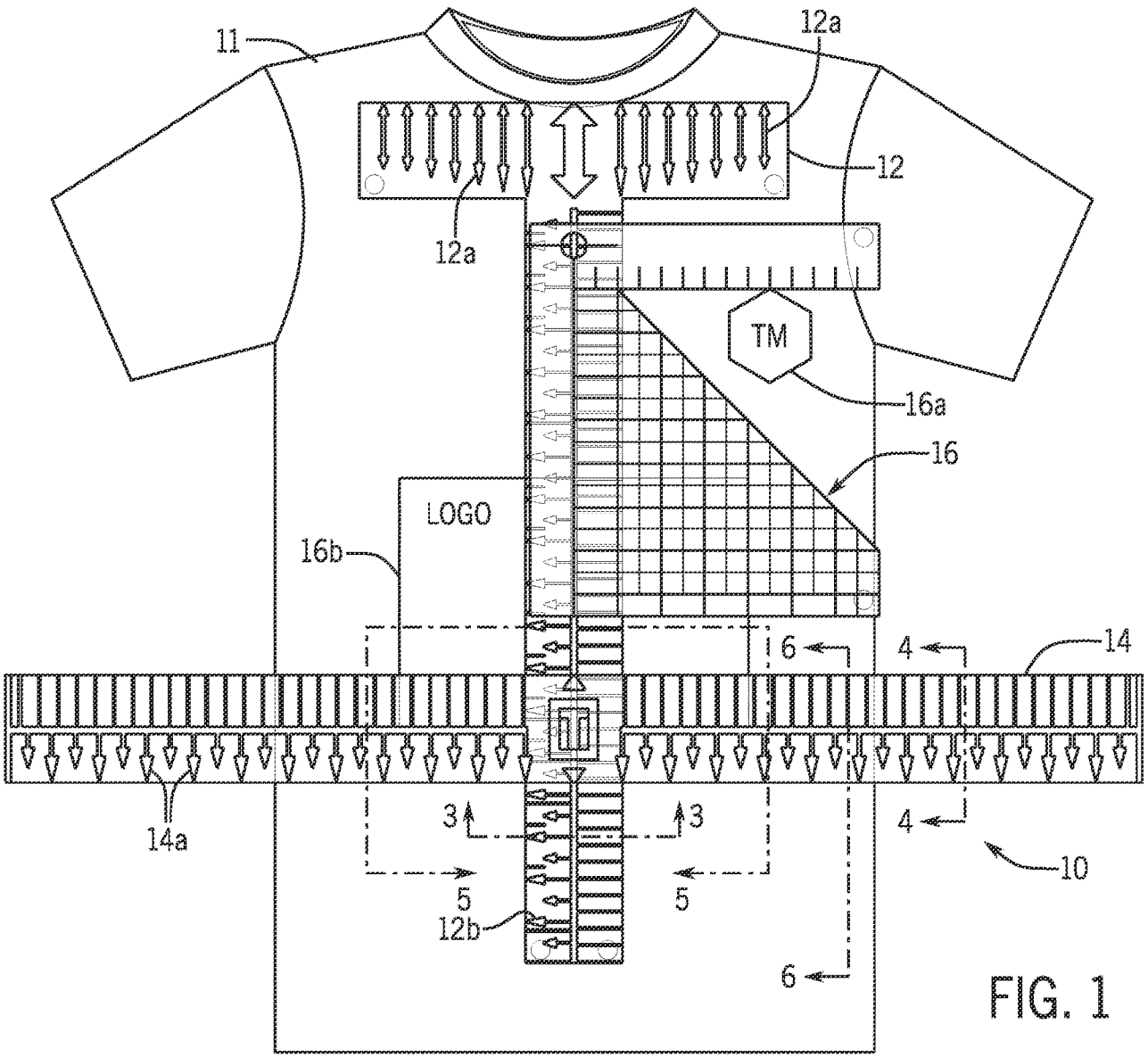
FIG. 1 is a top plan view of the graphics alignment tool in use.

The following detailed description is of the best currently contemplated modes of carrying out exemplary embodiments of the invention. The description is not to be taken in a limiting sense but is made merely for the purpose of illustrating the general principles of the invention.

The present invention is a substrate and garment graphic three-piece acrylic alignment tool used together and separately. The present invention is used for orienting and applying heat pressed graphics to wares using a heat press.

The graphics alignment tool 10 of the present invention allows a user to quickly align and center a graphic element on an area of a substrate, such as a front, a back, a left-side, or a right side of a ware, such as an apparel item. A chest logo grid 16 which fits into a slot 20*a* on a T-shaped center bar 12. The graphics alignment tool 10 of the present invention gives added options for alignment of other areas of substrate 11 or apparel. The logo grid tool 16 is used to apply to chest area of a shirt 11.

Figure 2:
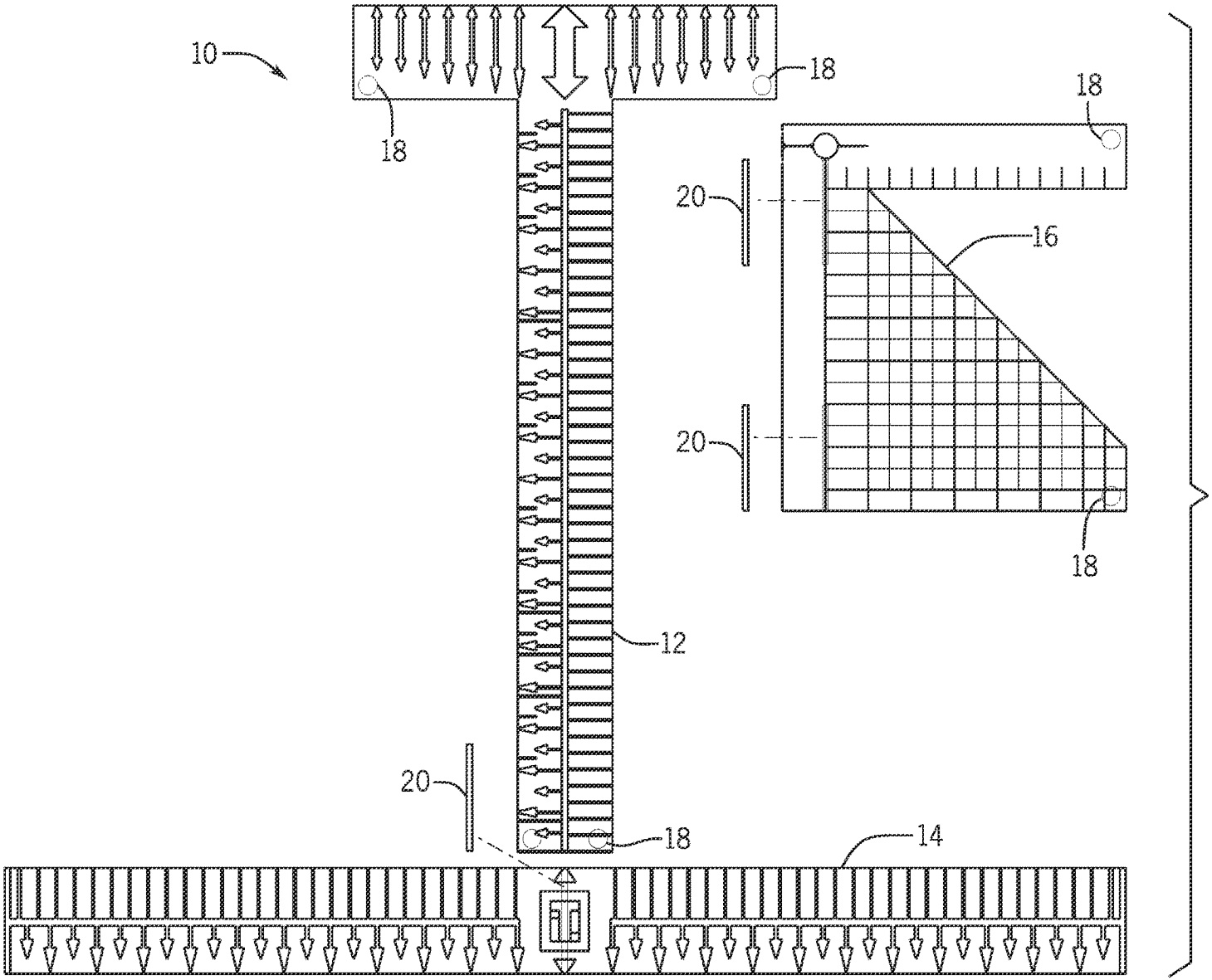
FIG. 2 is an exploded top plan view of the components of the graphics alignment tool.
Figure 3:
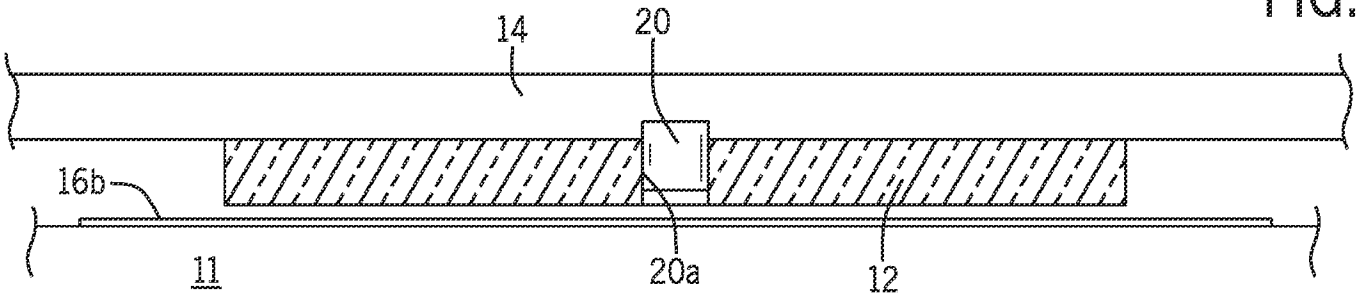
FIG. 3 is a detail cross-sectional view taken on line 3-3 of FIG. 1.
Figure 4:
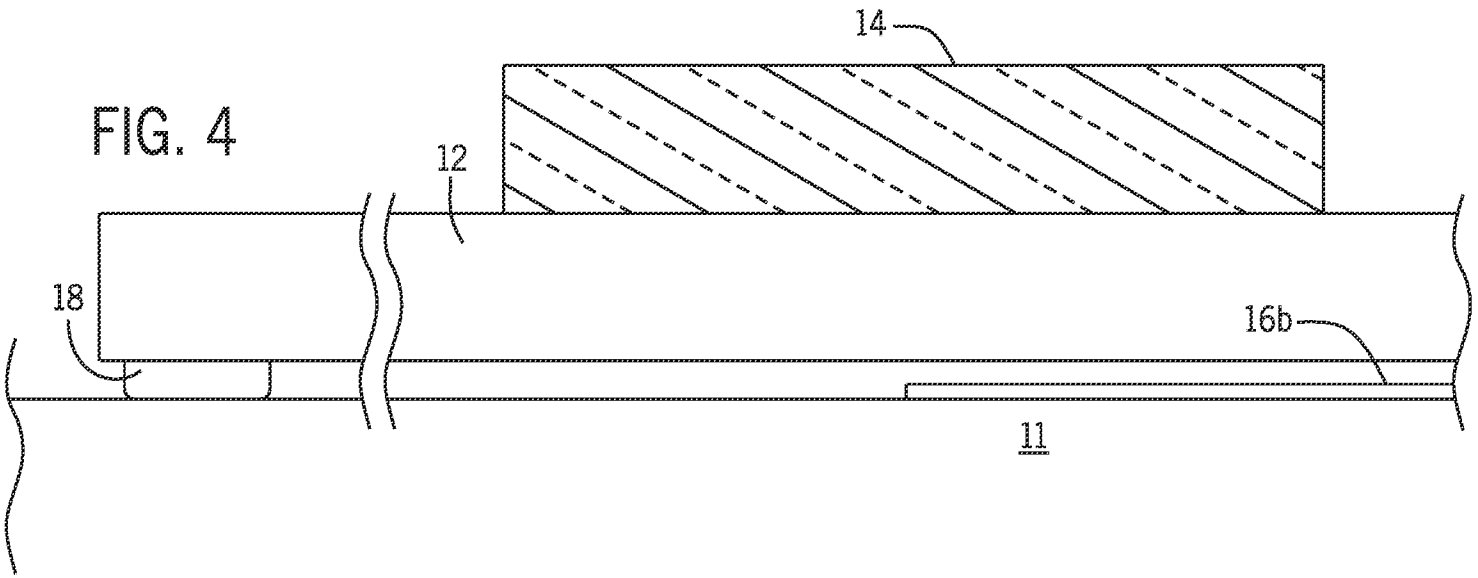
FIG. 4 is a detail cross-sectional view taken on line 4-4 of FIG. 1.
Figure 5:
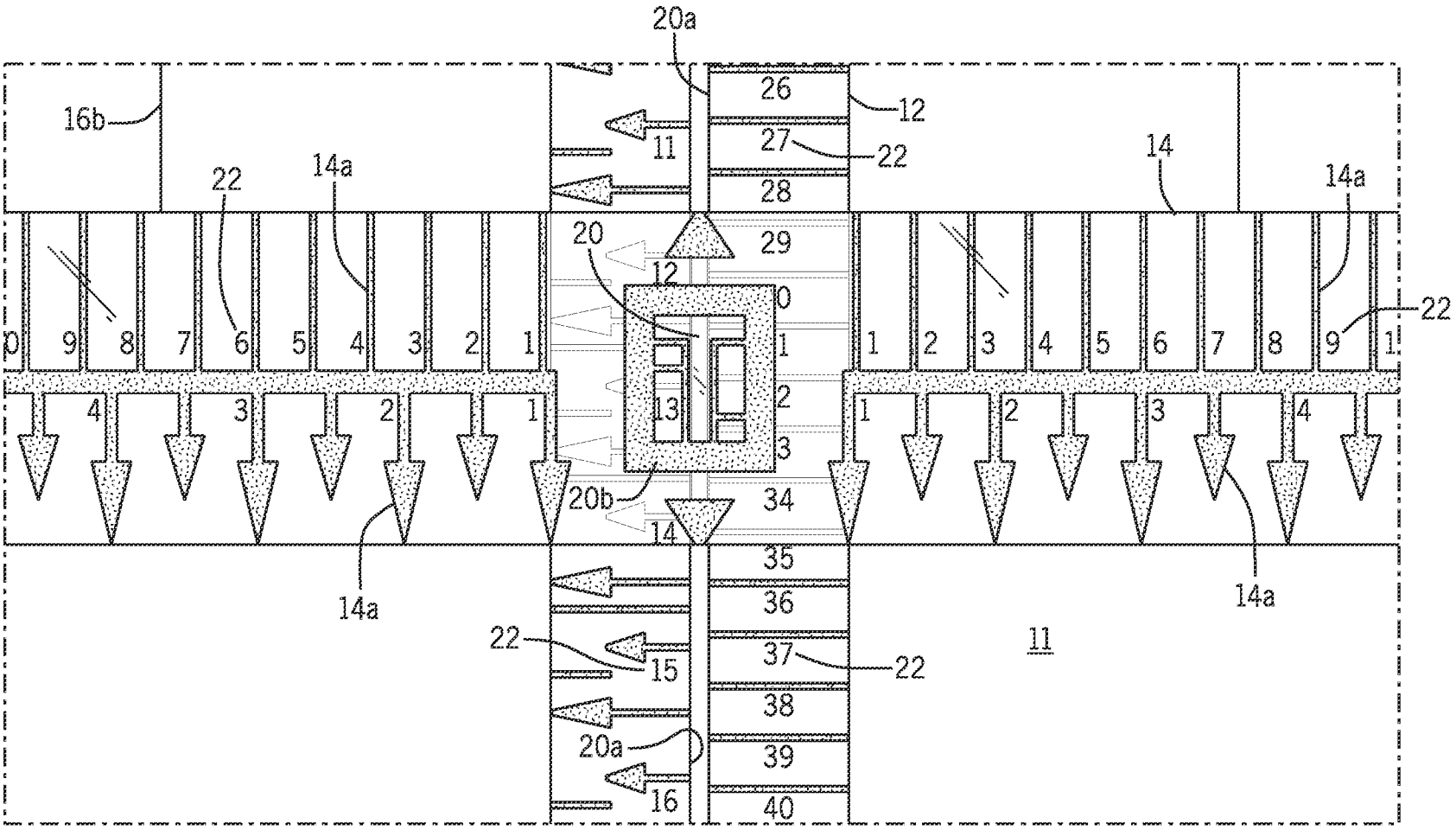
FIG. 5 is an enlarged detail plan view indicated by line 5-5 of FIG. 1.
Figure 6:
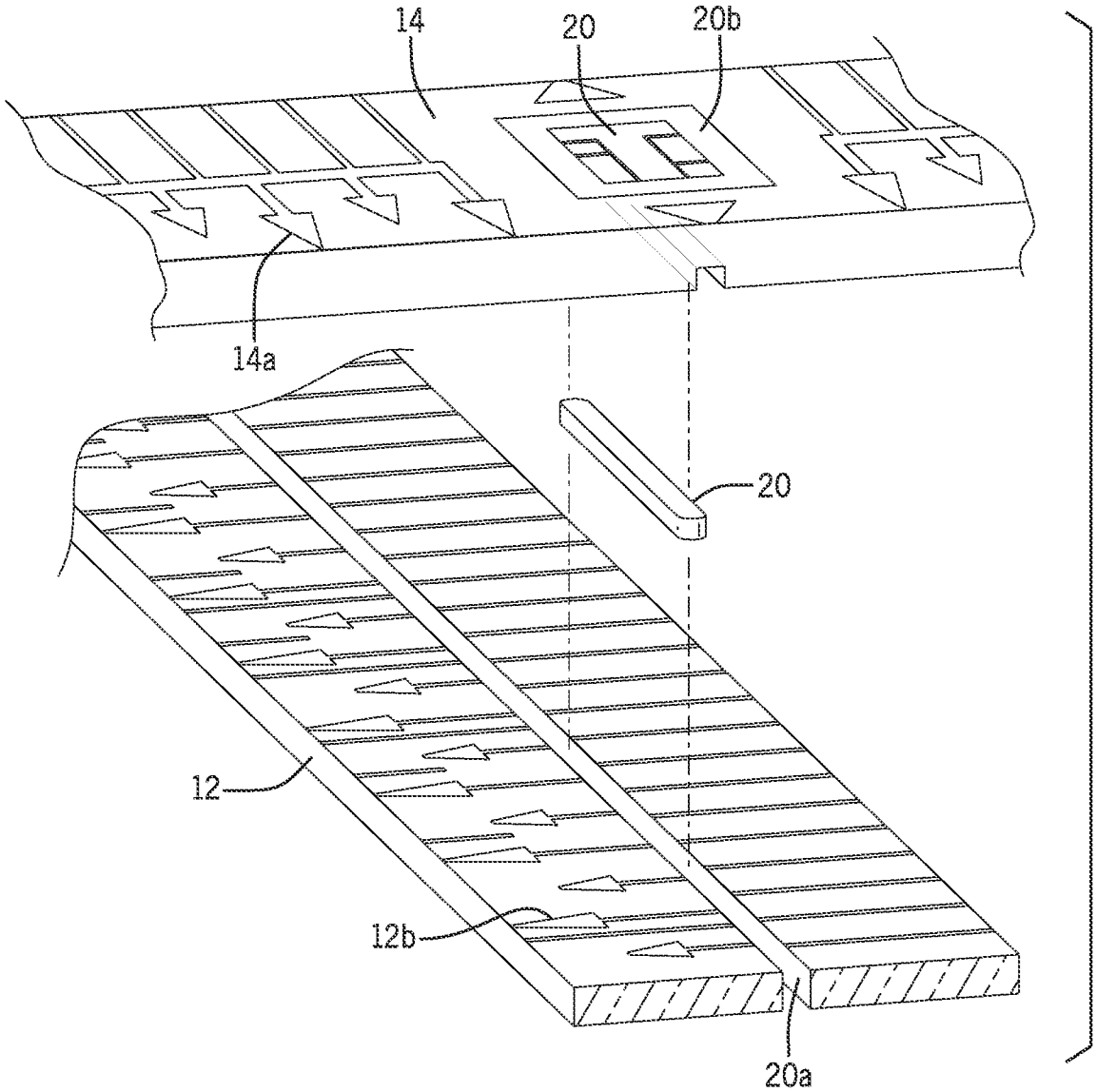
FIG. 6 is a detail exploded perspective view of a graphics alignment tool slider joint when positioned at line 6-6 of FIG. 1.

Referring now to the drawings of FIGS. 1-6, the graphics alignment tool 10 includes a T-shaped center bar 12, a width bar 14, a logo grid 16, and a top bar 10. The graphics alignment tool 10 is used to place graphic design on, a ware 11, such as an apparel or other substrate using a heat press. The above-mentioned components may be made of a clear plastic, such as acrylic plastic, and include a plurality of markings screen printed on their surfaces. The graphics alignment tool is used for accurate placement of a design element 16*a*, 16*b* on garment 11 or substrate.

A collar alignment indicia 12*a* are disposed transversely in a spaced apart relation along the top of the T-shaped center bar 10 for alignment with a seam of a collar of the garment 11. The center bar 10 also includes a plurality of vertical spacing indicia disposed vertically in a spaced apart relation along the center bar 10. For aligning and centering a design 16*b* or graphic using top bar 10 collar (3/16×2.5×9) plate for top placement and center bar 12 (3/16×2×18) for placement down center of the apparel 11 or substrate. A slot 20*a* is defined along a longitudinal length of the center bar 10.

The width bar 14 (3/16×2×24) which is placed on top of center bar 12 and is removably connected with a rail 20 (1/8×2) positioned in an alignment slot 20*b* in the width bar 14. The rail 20 is received in the slot 20*a* (1/8×17.3/4) of the center of center bar 12. The slot 20*a*, alignment slot 20*b*, and the rail 20 provide for cooperative joining of the T-shaped center bar 12 and the width bar 14 in a squared orientation relative one another so that the width bar 14 may slide along a longitudinal length of the slot 20*a*.

In some embodiments, the indicia 12*a* of the T-shaped center bar 12 collar plate includes arrows ½ inch apart and may be marked numerically at one-inch intervals. The indicia 12*a* extend from a center line out a left-side and a right-side of the collar plate. The vertical length of the T-shaped center bar 12 may also have alignment markings on left side including arrows located 1 inch, ½ inch, and lines ¼ and ½ inch apart. The T-shaped center bar 12 has line markings on the right side that are metric (cm) and are marked numerically.

The width bar 14 may also have lateral placement indicia 14*a* that include arrows at the bottom at ½ inch and one inch, with each one-inch arrow marked numerically. The number reads from center out to a left-side and right-side from the center. The width bar 14 may also include metric markings along a top edge with the lines marked numerically from center out to the left-side and the right-side. The center of the width bar 14 has arrows above and below logo that indicate center of the width bar 14. Although numbers are used on the unit are a placement guide. The numbers provide a reference to location. There are two silicone round feet 18 attached to a bottom surface of the T-shaped center bar 12 that may be about ½ inch round×⅛ inch in depth to raise the tool off the surface of the garment 11 or substrate to make it easier to slide and position the design 16*b* under the alignment tool 10.

The logo grid 16 may be about 9 inches wide, about 10 inches long, about ⅛ inch thick clear acrylic. Markings may be screen printed on the surface of the logo grid 16. The logo grid 16 is used for accurate placement of a chest designs 16*a* or graphic on the garment 11 or substrate.

At least one grid alignment rod 20, such as a 3 inch ⅛ square rod, is received in a grid slot 20*b* in the logo grid 16 and the alignment slot 20*b* in the T-shaped center bar 12. A 5 inch by 6 angle is cut from right side to allow for placement of decal 16*a*, design, graphic. Preferably ¼ inch grids are printed right off of wording "Center Of Apparel". The square rod 20 under the unit easily snaps into the slot 20*a* on the T-shaped center bar 12 square the logo grid 16*e* and releasable join the logo grid 16 so that is slidable along the alignment slot 20*a* to provide a squared alignment of the logo 16*a* on the substrate 11.

Using the slot 20*a*, 20*b* and rod connection system on the T-shaped center bar 12, the present invention allows a user to use all components including the center bar 12, the width bar 14, and the logo grid 16 and slidably reposition them in a squared alignment. the center bar 12, the width bar 14, and the logo grid 16 themselves can be used separately but with less assurance of a proper alignment. The present invention allows a user to align design, graphics on apparel 11 or other substrates. This eliminates the chance of expensive errors in alignment of graphics 16*a*, 16*b*.

It should be understood, of course, that the foregoing relates to exemplary embodiments of the invention and that modifications may be made without departing from the spirit and scope of the invention as set forth in the following claims.

What is claimed is:

1. A graphic alignment tool for positioning a graphic on a substrate, comprising:

a T-shaped center bar having a base vertically disposed and a collar plate laterally disposed at a top end of the base, a slot defined along a longitudinal length of the base;

a width bar dimensioned to laterally extend across a width of the substrate, an alignment slot defined at a midpoint of the width bar and extending transversely across the width bar;

a rod configured to be received in each of the slot and the alignment slot to slidably retain the width bar in a squared orientation relative the T-shaped center bar;

a logo grid having an alignment grid disposed on a surface, and at least one grid slot defined along a vertical orientation of the logo grid; and at least one grid alignment rod, configured to be received in each of the slot and the grid slot to slidably retain the logo grid in a squared orientation relative the T-shaped center bar.

2. The graphic alignment tool of claim 1, further comprising:

a plurality of collar alignment indicia disposed transversely in a spaced apart relation along the collar plate of the T-shaped center bar, the collar alignment indicia providing for a centered alignment with a seam of a collar on the substrate.

3. The graphic alignment tool of claim 2, further comprising:

a plurality of vertical spacing indicia disposed in a vertically spaced apart relation along the longitudinal length of the T-shaped center bar.

4. The graphic alignment tool of claim 3, further comprising:

a plurality of lateral placement indicia disposed in a spaced apart relation across a length of the width bar.

5. The graphic alignment tool of claim 4, wherein each of the plurality of collar alignment indicia, the plurality of vertical spacing indicia, and the plurality of lateral placement indicia comprise arrows.

6. The graphic alignment tool of claim 5, wherein each of the plurality of collar alignment indicia, the plurality of vertical spacing indicia, and the plurality of lateral placement indicia further comprise a numeric designation.

7. A method of placing a graphic on a substrate, comprising:

placing a graphic alignment tool on the substrate, the graphic alignment tool having a T-shaped center bar, a base vertically disposed, a collar plate laterally disposed at a top end of the base, and a slot defined along a longitudinal length of the base;

placing a rod in the slot;

slidably joining a width bar, dimensioned to laterally extend across a width of the substrate, by receiving the rod in an alignment slot defined at a midpoint of the width bar and extending transversely across the width bar;

sliding the width bar along the longitudinal length of the base to obtain a desired placement of the graphic on the substrate; and slidably joining a logo grid with the base of the T-shaped center bar via a grid rod received in the slot and at least one grid slot defined in the logo grid.

8. The method of claim 7, further comprising:

sliding the logo grid along the longitudinal length of the slot to a desired placement of the logo grid with the substrate.

9. The method of claim 8, further comprising:

applying a graphic to the substrate at a position indicated by at least one of the width bar and the logo grid.

* * * * *